US007500805B1

(12) United States Patent
Brochu et al.

(10) Patent No.: US 7,500,805 B1
(45) Date of Patent: Mar. 10, 2009

(54) LOW-NEST HEIGHT THERMOPLASTIC LEACHING CHAMBER

(76) Inventors: Ronald P. Brochu, 4 Srittany La., Westbrook, CT (US) 06498; James J Burnes, 10 Tower Hill Rd., Deep River, CT (US) 06417; Roy E. Moore, Jr., 71 Blueberry Hill Reserve, Killingworth, CT (US) 06419; Daniel T. Swistak, P.O. Box 368, Newmarket, NH (US) 03857

( * ) Notice: Subject to any disclaimer, the term of this patent is extended or adjusted under 35 U.S.C. 154(b) by 0 days.

(21) Appl. No.: 11/018,198

(22) Filed: Dec. 20, 2004

Related U.S. Application Data

(63) Continuation-in-part of application No. 10/677,938, filed on Oct. 1, 2003.

(51) Int. Cl.
*E02B 11/00* (2006.01)
*F16L 9/12* (2006.01)

(52) U.S. Cl. ..... 405/43; 405/46; 405/49; 138/105; 138/173

(58) Field of Classification Search ..... 405/36, 405/43, 44, 46, 52, 53; 210/170
See application file for complete search history.

(56) References Cited

U.S. PATENT DOCUMENTS 4,759,661 A * 7/1988 Nichols et al. ..... 405/48
5,336,017 A 8/1994 Nichols
5,401,459 A 3/1995 Nichols et al.
5,511,903 A * 4/1996 Nichols et al. ..... 405/43
5,716,163 A * 2/1998 Nichols et al. ..... 405/43
6,612,777 B2 * 9/2003 Maestro ..... 405/49
2003/0219310 A1 11/2003 Burnes et al.
2005/0074286 A1 4/2005 Swistak et al.

OTHER PUBLICATIONS

United States Environmental Protection Agency, Decentralized Systems Technology Fact Sheet: Septic Tank Leaching Chamber, Sep. 2000, WPA 832-F-00-044.*

* cited by examiner

*Primary Examiner*—Tara L. Mayo
(74) *Attorney, Agent, or Firm*—Charles G. Nessler; Steven McHugh

(57) ABSTRACT

A continuous curve arch shape cross section corrugated injection molded thermoplastic chamber is provided and includes a body having a multiplicity of peak and valley corrugations running along the curve of the arch shape, wherein the multiplicity includes opposing sidewalls, each having a foot, opposing chamber ends connected to the body, the ends shaped to form joints with the ends of like chambers, a multiplicity of sprues, within spaced apart valleys, at elevations intermediate the foot and apex of the chamber, wherein each sprue has a first runner running upwardly alone the valley in direction of the apex, and a second runner running downwardly along the valley toward the foot, a base runner connected to the bottom of the second runner, running lengthwise along the foot of the chamber; and at least one third runner connected to the base runner and running upwardly along a peak adjacent the valley.

16 Claims, 6 Drawing Sheets

LOW-NEST HEIGHT THERMOPLASTIC LEACHING CHAMBER

This application is a continuation in part of U.S. patent application Ser. No. 10/677,938 "Corrugated Leaching Chamber" of Brochu et al., filed Oct. 1, 2003.

TECHNICAL FIELD

The present invention relates to chambers for receiving or dispersing liquids, in particular to injection molded thermoplastic leaching chambers and storm water chambers and features which enable good nesting.

BACKGROUND

Corrugated plastic leaching chambers receive and disperse wastewater when buried within soil and other media. They have been described in various U.S. patents, including U.S. Pat. No. 4,759,661, No. 5,336,017, and No. 5,551,903, all of Nichols et al. Such chambers have been sold commercially as Infiltrator® chambers. The prior art Infiltrator chambers and competitor chambers generally have arch shape cross sections with opposing side perforated planar sidewalls running up to the chamber top from bases which have flanges to support the chamber on the media within which it is buried.

The present invention is concerned with chamber configuration and method of making the chamber, to achieve unusual improvement in nestability. In particular, there is a big increase in number of chambers which can be stacked in a given height space. The greater the density of nesting, the more economically can units be shipped and stored, since costs for such are primarily proportional to product volume, not weight.

In the arch shape cross section molded thermoplastic chambers known previously, ribs running lengthwise and cross wise within the arch interior have been used for providing strength. Those ribs and the corrugation shapes have limited what minimum nesting height can be achieved. Some special combinations of features have provided advances. For example, U.S. Pat. No. 5,551,903 of Nichols et al. at Table 4 describes the geometry and dimensions of chambers which have nest heights of 1.5 to 2.5 in. But there is a continuing desire for further improvement. For example, if a 0.5 in. reduction of a 1.5 in. nest height in. can be achieved, then 100 chambers can be stacked in the space previously occupied by 67 chambers. That could translate into as much as 33 percent reduction in shipping expense per chamber.

Recently, improved chambers have been introduced and sold commercially as Infiltrator® Quick4™ chambers. An exemplary chamber is illustrated by FIG. 1 herein. The chambers are further described in co-pending U.S. patent application Ser. No. 10/677,772 "Leaching Chamber with Inward Flaring Sidewall Perforations" of Swistak et al. and in the parent application herein. As reference to commercial products and the patent applications will show, the new chambers have various innovative features including a base flange with ribs and a lengthwise fin along the outer edge; and, sidewall slot perforations which are present to an elevation just above such kind of base flange.

SUMMARY

An object of the invention is to provide for low nest height in a chamber, particularly to provide a corrugated chamber which is free of ribs on the curved arch of the body. Another object is to provide for low mass sprues on a leaching chamber which is free of ribs and which has sidewall perforations made with mold cores parts which slide inwardly within the concavity of the arch shape.

In accord with the invention, a continuous curve arch shape cross section corrugated injection molded thermoplastic chamber has a multiplicity of sprues, within spaced apart valley corrugations, at elevations intermediate the foot and apex of the chamber. From each sprue runners carry plastic during molding. A runner goes upwardly toward the apex of the chamber. Another runner goes down to the base to base runner which runs lengthwise along the underside of the base to one or more adjacent peaks, and preferably, the next valley, at which locations the runners go upwardly in the respective peak or valley. Runners preferably run along the interior of the chamber. When a runner reaches proximity of the intersection of a valley or peak and the chamber foot, the runner travels on the exterior of the chamber.

In further accord with the invention, sprues have undersides, within the interior of the chamber, which are flat and which slope upwardly at nominally the same angle as the angle of the hole perforations have relative to the base of the chamber.

A preferred embodiment chamber which has the foregoing runner system and which has a body that is free of ribs is made of polypropylene, has basic wall thickness of about 0.09 in., and a nest height of less than 1.5 in., more preferably about 1 in.

In accord with the invention, a leaching chamber is made by a mold which comprises a core part and a mating cavity part. The core part has slides, with projections which define perforations in the chamber sidewall. After plastic has been injected into the mold to form the part, the slides move inwardly, preferably simultaneously upwardly, along the projections of the basic axes of the perforations in the chamber sidewall.

Preferably the mold has a core part comprised of opposing slides, movable of a floating plate, positioned between a core part base plate and the mating cavity part. A center wedge block is positioned between the slides during molding, to form the top of the chamber. After molding, the block moves down, away from the chamber top, to thereby provide space for the inward movement of the slides. The motion of the wedge block and the slides is accomplished by the effects of shafts extending from the base plate, when the floating plate and the base plate move in a pre-determined way.

Chambers made in accord with the invention are particularly light and strong.

The foregoing and other objects, features and advantages of the present invention will become more apparent from the following description of preferred embodiments and accompanying drawings.

DESCRIPTION

Figure 1:
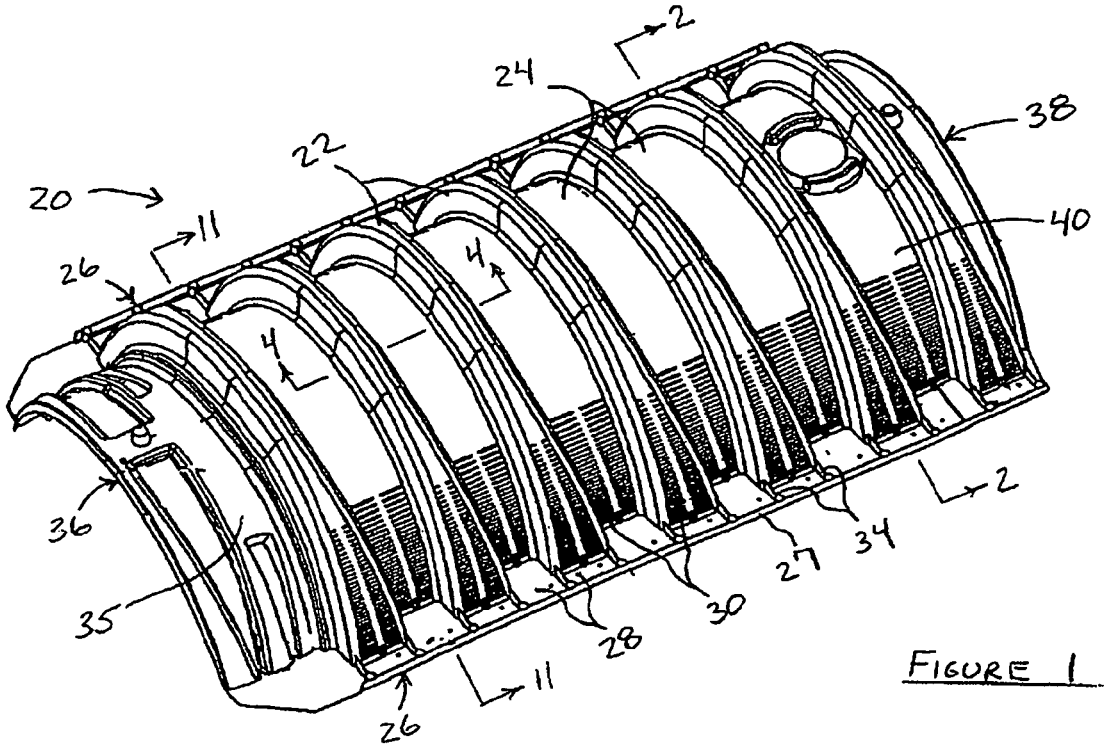
FIG. 1 is an isometric view of an arch shape cross section corrugated leaching chamber.

FIG. 1 is an isometric view of chamber 20, which is like that described in the parent application here, and in U.S. patent application Ser. No. 10/677,772 "Leaching Chamber with Inward Flaring Sidewall Perforations" of Swistak et al., the drawings and specifications of which are hereby incorporated by reference. (FIG. 1 and some other figures have some artifact wire-frame drawing lines, mainly running lengthwise.) Preferably, chamber 20 is made of injection molded commercial polypropylene, alternately high density polyethylene. Use may be made of gas-assisted injection molding methodology described in U.S. Pat. No. 5,401,459, and in the references cited therein.

Figure 2:
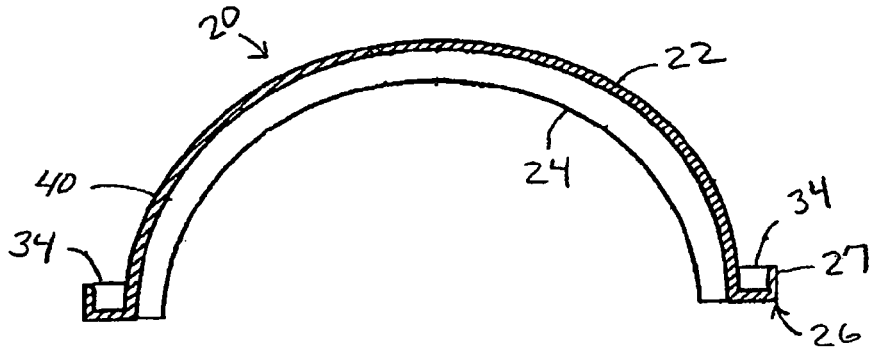
FIG. 2 shows a vertical cross section through the chamber of FIG. 1.
Figure 11:
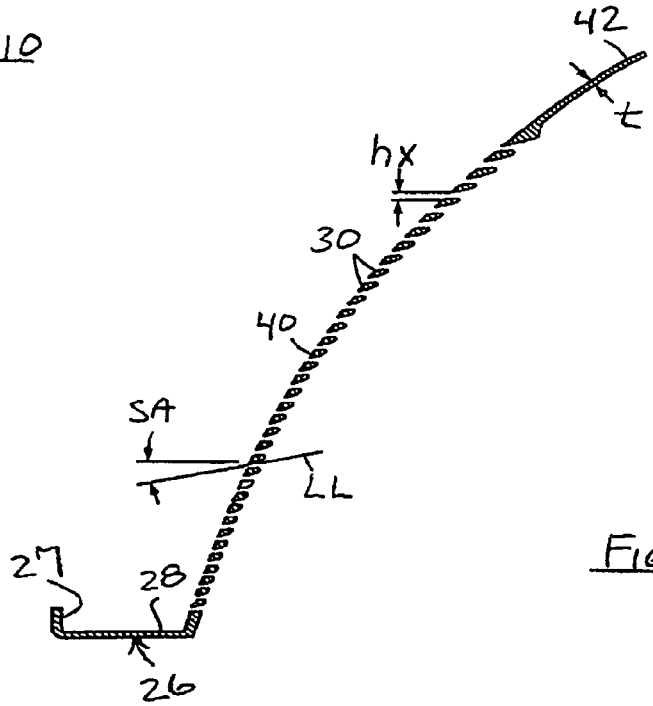
FIG. 11 is like FIG. 2, showing one of the two perforated chamber sidewalls with a foot.

Chamber 20 has corrugations which comprise peaks 22 and valleys 24 which run along the continuous curve of the arch shape cross section. The vertical cross section of chamber 20 in FIG. 2 shows the continuous curve shape, which is preferably semi-elliptical. FIG. 11 is a partial vertical cross section at a different chamber length location. It shows the lengthwise running slot perforations 30. Perforations alternately may have other shape; and, the invention herein is useful with chambers having very few or no perforations. FIGS. 1, 2 and 11 omit showing the runners of the present invention, discussed below.

Chamber 20 has a main body which comprises the repetitive similar corrugations, and a first end 36 which comprises a dome portion 35. The dome is a portion of a surface of revolution, strengthened by shallow trapezoidal surface depressions. The opposing second end is shaped to fit the dome, so that an identical chamber can be overlaid on the first end of chamber 20, to form a joint between the chambers which accommodates pivoting at the joint. See U.S. patent application Ser. No. 10/442,810 of Burnes et al. for more details. Chamber sidewalls 40 run from feet 26 at the base, upwardly toward the apex of the chamber. The slot perforations have through-wall central axes LL of which slope downwardly at angle SA. See FIG. 11. Angle SA will be between 6 to 14 degrees, preferably about 12 degrees, from horizontal. The holes flare inwardly. They have an exterior height hx which may be constant or may increase with elevation, as detailed in the parent application. Vertical fin 27 runs along the outer edge of the flange. Vertical ribs 34 run across flange 28 to connect the edges of the bottoms of the peak corrugations 22 with the fin, to provide strength to the flange. At the fin-rib intersections round pillars shown in some views are mold knock-out pin artifacts.

Basic wall thickness t is the nominal wall thickness of the chamber wall, away from perforated areas, for instance, in the corrugation webs, at the top, and in the base flange. The thickness of the sidewall may be nominally constant or may change with elevation, as described in the parent application. A preferred chamber 20 has a basic wall thickness of about 0.09 in. Wall thicknesses may be ascertained by direct measurement or by calculation, e.g., dividing the material volume by the surface area of the portion of interest.

Figure 6:
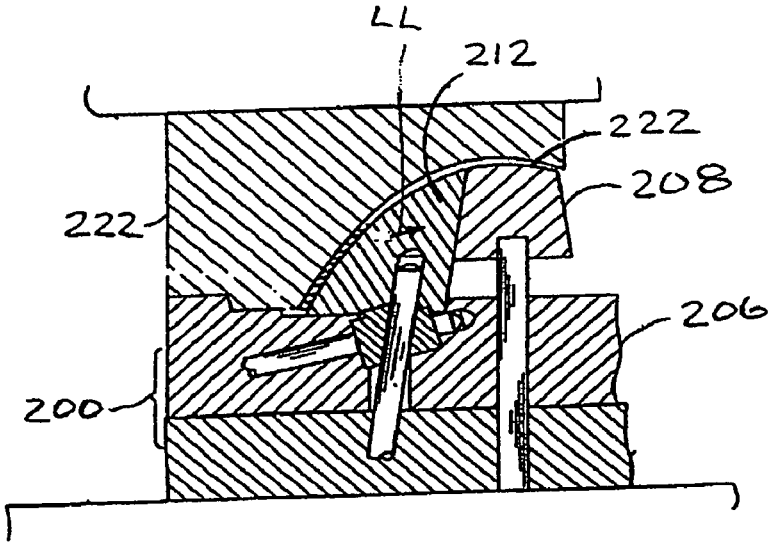
FIG. 6 is similar to FIG. 5, showing different parts of the mold, at a different location along the length of the mold and chamber.

Chamber 20 is formed in an injection molding machine using a special mold which is comprised of two major parts, core 200 and the cavity 222. See FIG. 6, which is a simplified reproduction of FIG. 7 of the aforementioned Swistak et al. application. The core part comprises two opposing sidewall-perforation defining slides 212 which pull inwardly. That feature enables the simultaneous forming of fin 27 and the perforations 30, especially those which are lowermost, which prior art outside pull slide molds cannot accomplish. Fig. Briefly, the mold has a core part 200 comprised of opposing slides 212, movable on a floating plate 206. Core 200 is positioned between a core part base plate and the mating cavity part 222. A center wedge block 208 is fits between slides 212 during molding, to define the top part of the chamber. After molding, block 208 moves down, away from the chamber top. That provides space for inward movement of slides 212 along inclined axes LL. The motion of the wedge block and the slides is accomplished by the means of shafts which extend from the base plate, and by actuation which results when the floating plate and the base plate move in a pre-determined way, to open the mold so the part can be removed.

Figure 8:
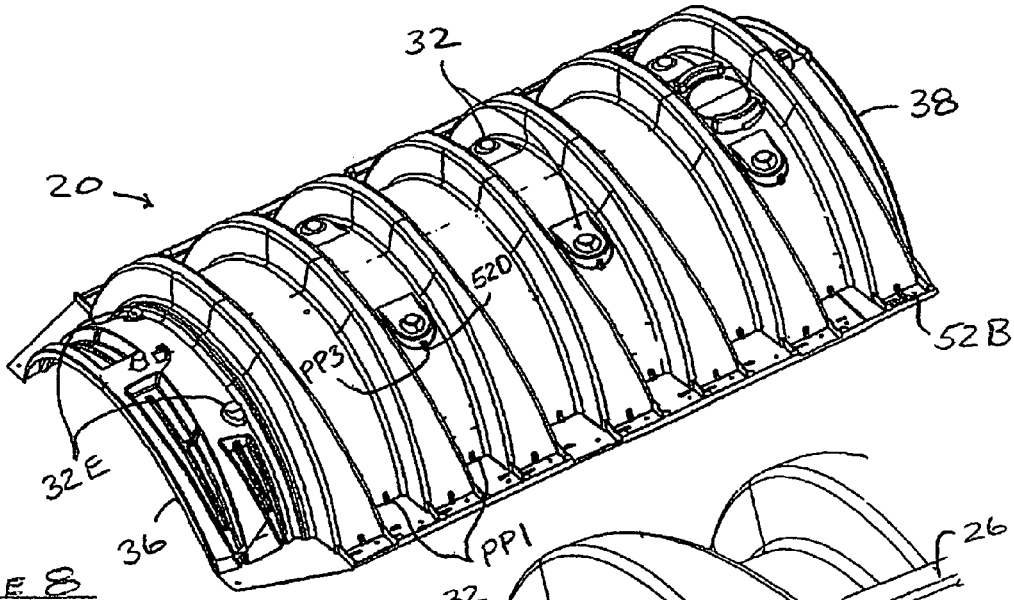
FIG. 8 is like FIG. 1, showing sprues and runners which are on the exterior of the chamber.

FIG. 8 is like FIG. 1 but shows features omitted in FIG. 1 to avoid clutter. Chamber 20 has six primary sprues 32, in alternating valleys. They are at elevations intermediate the foot and top of the chamber, as shown, just above the elevation at which perforations end. FIG. 8 shows two smaller secondary sprues 32E for delivering plastic to the dome end 36.

Figure 5:
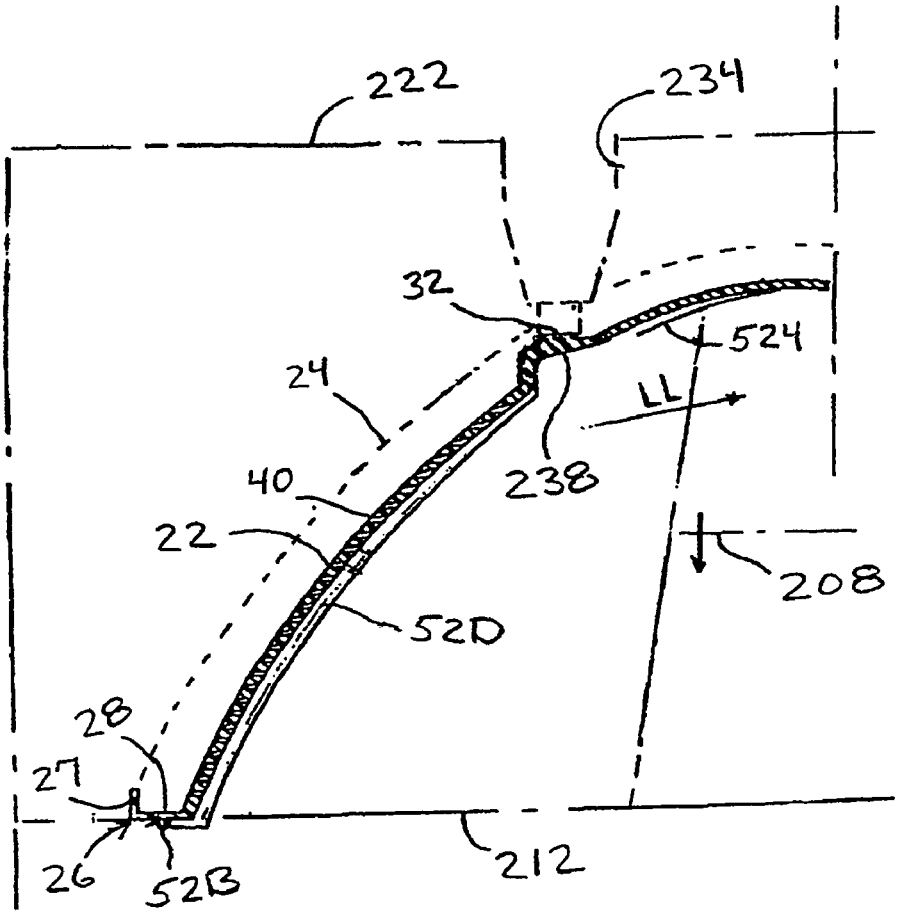
FIG. 5 is a partial cross section elevation view of a chamber within a plastic injection mold.
Figure 7A:
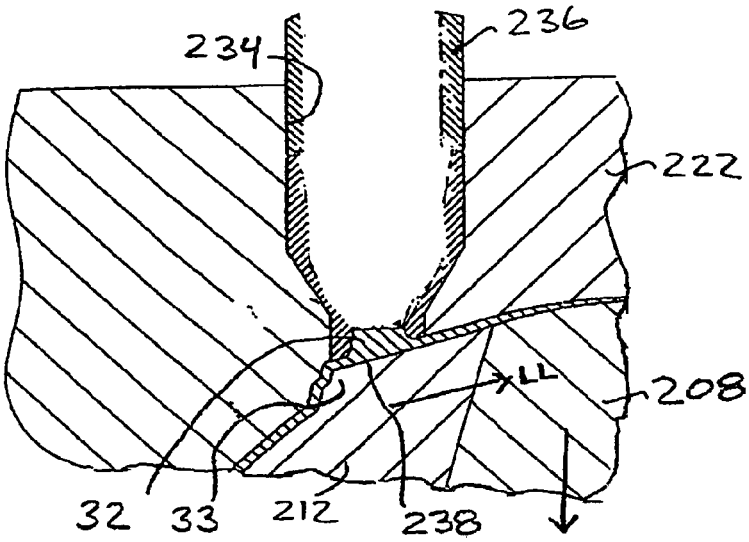
FIG. 7A is similar to FIG. 5, showing in more detail how nozzle is located relative to a chamber part and the shape of the sprue which is formed on the part.

FIG. 5 is a vertical cross section through the chamber of FIG. 8, at a valley which has a sprue 32. The essential mold parts 212, 203 and 222, discussed above, are shown in phantom. Mold cavity 222 has a multiplicity of ports 234 for receiving the injection molding machine nozzles. FIG. 7A is like FIG. 5 and shows a nozzle 236 within the cavity part of the mold, along with plastic part which has just been formed within the mold hollow. The arrows show how the core parts subsequently move, as previously described, to enable removal of the part.

Figure 7B:
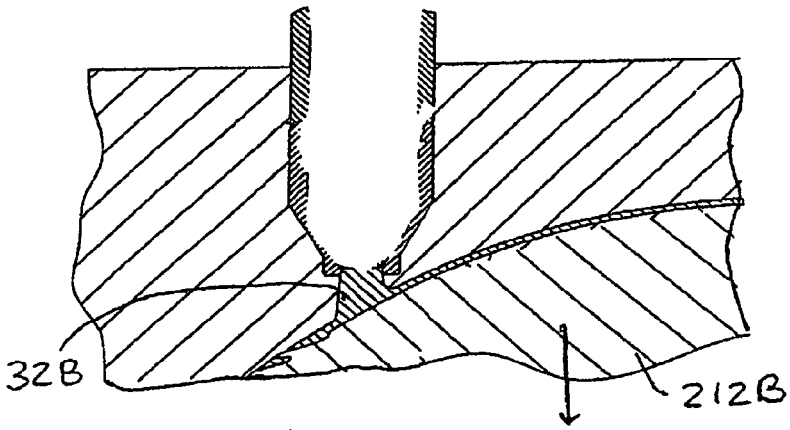
FIGURE 7B PRIOR ART
FIGS. 7B and 7C are like FIG. 7A, showing prior art molds and sprues.
Figure 7C:
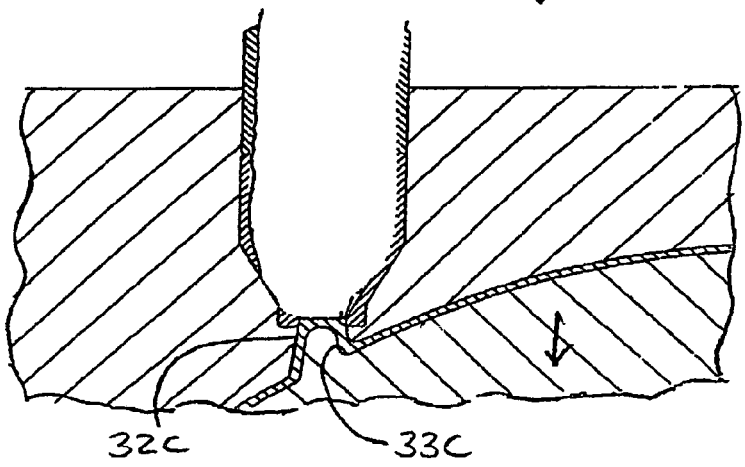
FIGURE 7C PRIOR ART

Sprues are typically-unwanted artifacts associated with injection molding machine nozzles, which flow plastic into the mold hollow during molding. The term is used interchangeably to refer to an injection location cavity within the mold, and the portion of the article which is results. Since sprues typically have greater mass and heat than the adjacent portions of the part, they tend to cool more slowly. That behavior can induce subsequent distortion of a cooling part, or necessitates increased retention time in the mold after injection. With a rising curved surface, like that of the chamber side wall, the nozzle can only come within a certain vertical proximity of the part. Thus, the sprue has had an irreducible height. As illustrated by FIGS. 7B and 7C, different approaches have been taken to reduce the mass of the sprue. Sprue 32B of FIG. 7B is larger than wanted and leads to distortion, long cooling time, etc. Sprue 32C shows the conventional approach wherein core part 33C forms a hollow inside the sprue to reduce its mass. However, in the invention chamber, where the slides 212 withdraw inwardly from the chamber wall, that feature is not feasible. And moving the nozzle nearer to the top of the chamber is also not feasible for the thin wall chamber, given the absence of ribs and very thick runners.

Figure 3:
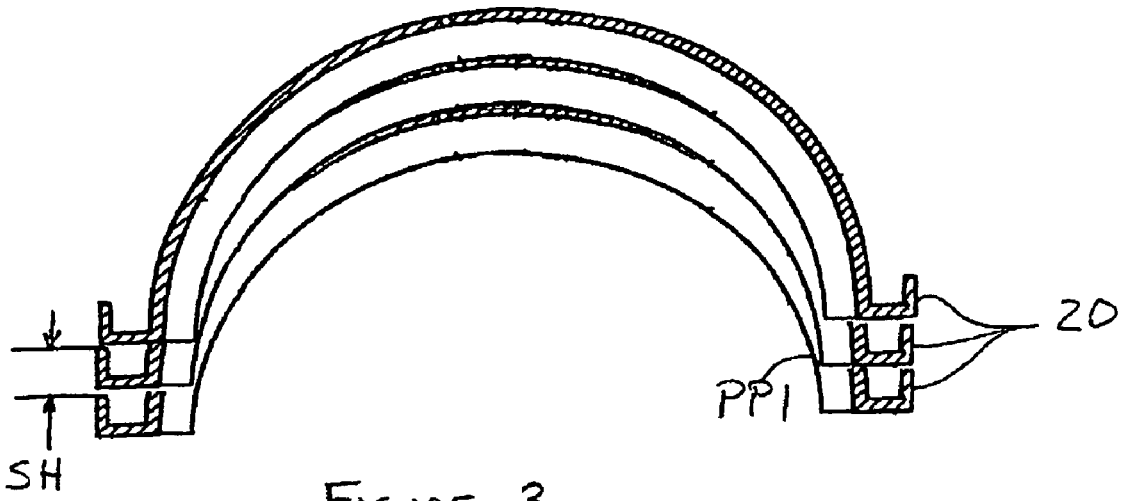
FIG. 3 is like FIG. 2, showing three nested chambers.

Referring again to FIGS. 5 and 7A, in the invention, typical sprue 32 has substantially planar underside surface 238 and thus reduced mass, to improve cooling and lessen tendency for distortion. The surface 238 nominally follows the slope of line LL, e.g., 12 degrees from horizontal, which is the slope of the axes of slots 30. (The slots do not appear at the cross section plane of this Figure.) Thus, in the invention the sprue mass is reduced by means of the core part 33 which makes the sprue bottom flat In chambers 20 the nest height SH of stacked chambers 20 is a function of the geometry and dimensions. The nest height is limited by interference of certain portions of the chambers, which are called pin. points. They are designated in the drawings with PP plus a suffix number. When one pin. point is eliminated, another will then limit nest height. FIG. 3 shows how opposing sides of the bottoms of the corrugations creates a pinch point PP1, FIG. 4 illustrates the pin. point PP2 which occurs at the webs of the peaks.

Figure 4:
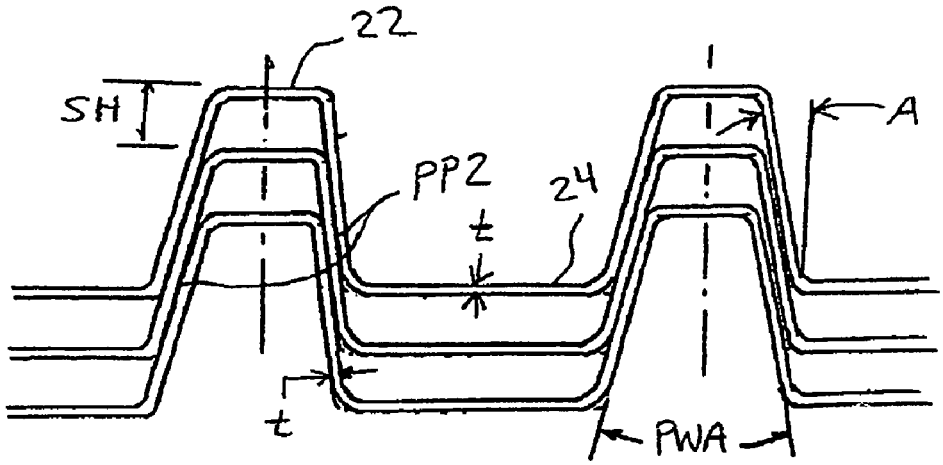
FIG. 4 is a longitudinal vertical plane view of the corrugation apexes of three nested chambers.

With reference to FIG. 4, the peaks of the exemplary chambers 20 have webs which slope at angle A of about 6 degrees from the vertical plane, resulting in an about 12 degree included angle PWA for the opposing webs of a peak corrugation 22.

The invention chambers nest with superior nest height, of less than about 1.5 in. because of the combination of features which include the continuous semi-ellipse arch cross section, the lack of consequential internal ribs, the avoidance of lengthwise runners along the top of the chamber, particularly along the webs. There also are no transverse ribs on the arch curve portions of the chamber. (There are ribs 34 on the outside of the chamber at the foot.)

While the body of chamber 20 is free or ribs as they are defined here, there may be small drip ledges which run lengthwise along top interior of the chamber. A typical drip ledge will be tapered in cross section. It have a thickness (which would be called "height," if it were a rib) of about 0.18 in. and a width of about 0.1-0.25 in. at the base. The thickness (height) of the drip ledges is limited to not exceed the space between one the peaks and valleys of nested chambers, so as to not change nest height. The dome end of the chamber may have a few transverse ribs near the outermost top for strength, at location 37 in FIG. 8. While prior art corrugated chambers might have been made in the past without ribs, they would not have met the ordinary requirements for such chambers, most particularly, that the chambers meet standards, such as AASHTO H-10 or H-20 rating, which relates to resisting the load from a vehicle on soil surface overlying the chamber.

The chamber is successfully made as a result of the unique way in which plastic is flowed using runners 52 which only run along the curve of the corrugated arch shape, on the interior or exterior. Those kinds of runners are also sometimes called hoop runners.

Runners are localized thickened sections of the chamber wall, also called flow channels, which provide for flow of plastic (and gas, when gas assist injection molding is used) from sprues. Runners are distinguished from ribs in being relatively squat. In the invention, a typical runner thickness is less than about 350 percent, typically in the range 250-300 percent of basic wall thickness t. Runner thickness includes the thickness of the wall along which the runner runs. In the invention, a preferred runner is about 0.25 in. thick, for a chamber which is about 0.09 in. (In contrast, a typical rib is tall and thin and has a thickness (more often characterized as the rib height) which is typically 400-500% in of the basic wall thickness. See FIGS. 16 and 17 of the parent application for visual distinction between runners and ribs. See also U.S. Pat. No. 5,716,163 for other examples of such ribs.

Figure 9:
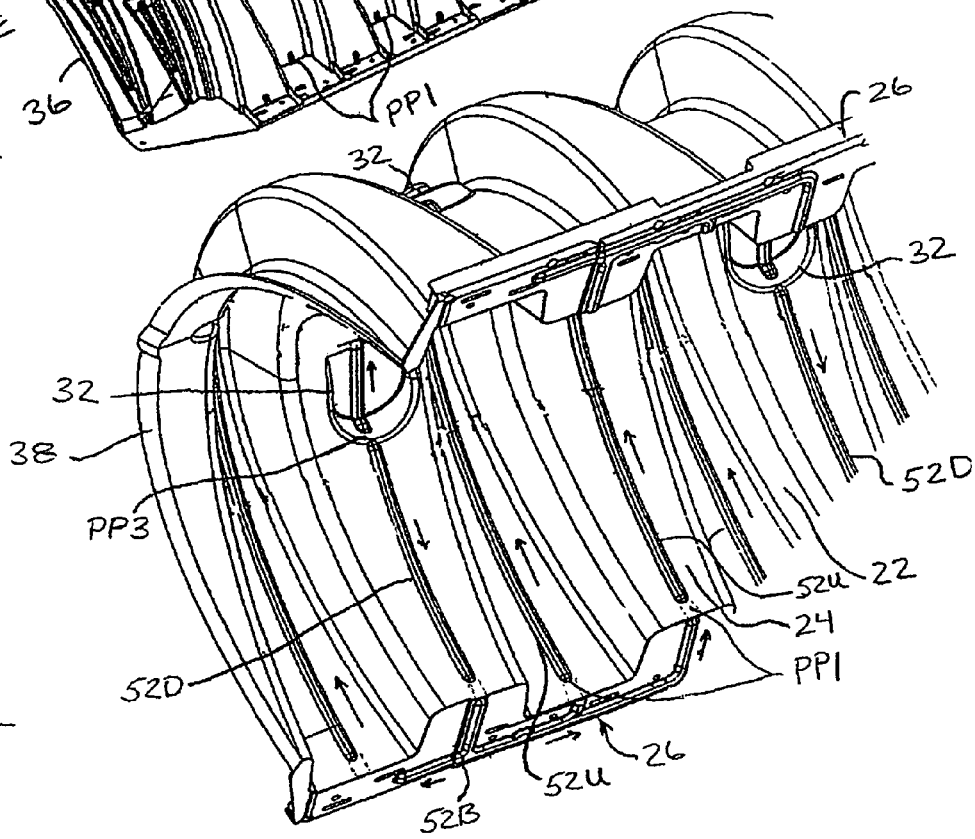
FIG. 9 is a view of the underside of and end of the FIG. 8 chamber.
Figure 10:
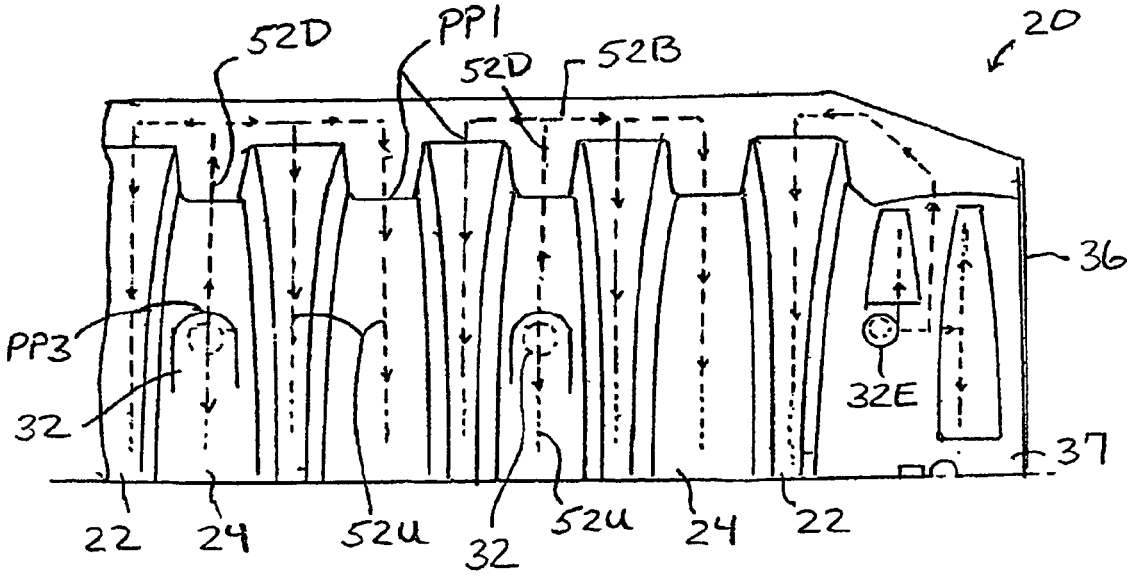
FIG. 10 is a top view of the FIG. 8 chamber with interior and exterior runners shown as dashed arrow lines, to illustrate how plastic flows from sprue locations during molding.

FIGS. 8-10 shows the lay out of the runners. In FIG. 10 they are represented by dashed lines. All runners described are on the interior of the chamber or on the underside of the flange 28 of the base, unless otherwise stated. The 6 primary sprues 32 are located in the valleys just above where the perforations stop. From each sprue runner 52U runs upwardly and fades into the sidewall as the runner approaches the apex of the chamber. From each sprue runner 52D runs down to the elevation of the base flange. Runners 52B run lengthwise on the underside of the base flange to connect the various hoop runners, 52U, 52D.

For example, as best seen in FIG. 10, runners 52U run upwardly from the base in adjacent peaks on either side of the valley of the sprue, and up one valley which lies beyond one of the peaks. Looking down on the chamber, the base runner path has an E-shape, where the E has a double cross bar. The downward flowing runner 52D is one of the two cross bars.

The runners have a thickness of about 0.25 in., as mentioned, and a width of about 0.38 in. Plastic flowing along the runners also flows laterally, of course within the peaks and valleys, to fill the portions of the mold along the runner path. Thus a solid part is made. In this aspect of the invention, the connection with the base runners may be somewhat different. The flow from any valley sprue is at least connected so it flows up an adjacent peak. It is undesirable, but possible to use more sprue locations.

In an exemplary chamber, the vertical dimensions of the ribs and fin of the base flange are chosen so that the webs of the peak corrugations 22 come vertically to within about 0.005 in. of full contact or engagement. That is, one web of the outside a typical peak may contact the inside of the peak of the overlying chamber, but both webs of the peak will not fully contact the webs of the other-chamber peak. That avoids a tendency of the corrugations and chambers to wedge together. The distance between the bottom of one base flange and the next, or the nesting height, of exemplary chambers is just under one in., for instance about 0.9 in. Optionally, changes in chamber geometry may be made, so that somewhat less advantage is obtained. For instance, the nest height may be increased up to about 1.5 in. As the text in the Background section here indicates, making a perforated wall leaching chamber a nest height of 1.5 in. or less, preferably about 1 in., is a surprising result. This is particularly so when the chamber is strong enough to meet overlying soil-vehicle load standards, the chamber has leaching performance comparable prior art chambers. Although this invention has been shown and described with respect to a preferred embodiment, it will be understood by those skilled in this art that various changes in form and detail thereof may be made without departing from the spirit and scope of the claimed invention.

We claim:

1. A continuous curve arch shape cross section corrugated injection molded thermoplastic chamber, comprising:

a body having a multiplicity of peak and valley corrugations running along the curve of the arch shape, wherein said multiplicity includes opposing sidewalls, each having a foot;

opposing chamber ends connected to the body, the ends shaped to form joints with the ends of like chambers;

a multiplicity of sprues, within spaced apart valleys, at elevations intermediate the foot and apex of the chamber wherein each sprue has a first runner running upwardly along the valley in the direction of the apex, and a second runner running downwardly along the valley toward the foot;

a base runner connected to the bottom of said second runner, running lengthwise along the foot of the chamber;

and at least one third runner, connected to the base runner and running upwardly along a peak adjacent the valley.

2. The chamber of claim 1, further comprising a fourth runner connected to the base runner and running upwardly the other peak which is adjacent the valley.

3. The chamber of claim 1 wherein the basic thickness of the body is at least 0.090 in. and the nest height of the chamber is less than 1.5 in.

4. The chamber of claim 3 further comprising a fifth runner connected to the base runner and running upwardly along a second valley which is spaced apart from the valley of the second runner by a peak.

5. The chamber of claim 3 wherein the second runner runs along the interior of the arch curve of the chamber, down to proximity of the intersection of the valley and foot, and then on the exterior of the chamber, to the flange of the base.

6. The chamber of claim 1 wherein the base runner runs along the bottom side of the foot.

7. The chamber of claim 1 wherein the nest height is less than one in.

8. The chamber of claim 1, wherein the body of the chamber is free of ribs.

9. The chamber of claim 1, wherein the chamber sidewalls are perforated.

10. A continuous curve arch shape cross section corrugated injection molded thermoplastic chamber, comprising:

a body having a multiplicity of peak and valley corrugations running along the curve of the arch shape, wherein said multiplicity of peak corrugations includes opposing sidewalls, each having a foot, wherein each of the opposing sidewalls include an inner surface disposed within the chamber, the opposing sidewalls configured to form an angle PWA between the inner surfaces of about 12 degrees; and opposing chamber ends connected to the body, the ends shaped to form joints with the ends of like chambers;

wherein, the body is free of lengthwise ribs and wherein, when a plurality of said chambers is nested for shipment, the nest height of each chamber is substantially less than 1.5 in.

11. The chamber of claim 10, wherein the body is free of ribs running along the arch curve.

12. The chamber of claim 10 wherein the nesting height is about one in.

13. A continuous curve arch shape cross section corrugated injection molded thermoplastic chamber, comprising:

a body having a multiplicity of peak and valley corrugations running along the curve of the arch shape, wherein said multiplicity of peak corrugations includes opposing sidewalls running upwardly from feet at the base of the chamber, the sidewalls having perforations which run on a downward slope from interior to exterior of the chamber, wherein each of the opposing sidewalls include an inner surface disposed within the chamber, the opposing sidewalls configured to form an angle PWA between the inner surfaces of about 12 degrees; and at least one sprue, within a valley at an elevation intermediate the foot and apex of the chamber, the sprue having an interior surface which runs upwardly on the same slope as said perforations.

14. The chamber of claim 13 further comprising runners, running from the sprue along the valley both upwardly toward the apex and downwardly toward the foot.

15. The chamber of claim 14 wherein the runner which runs downwardly runs predominately along the interior surface of the valley, the runner running on the exterior surface of the chamber at the lower end of the sprue and at the point where the valley meets the foot.

16. The chamber of claim 15 wherein the body of the chamber is free of ribs.

* * * * *